US006334839B1

(12) United States Patent
Lim et al.

(10) Patent No.: US 6,334,839 B1
(45) Date of Patent: Jan. 1, 2002

(54) TREADMILL WHICH CAN BE DRIVEN IN BOTH DIRECTIONS

(75) Inventors: Jung Soo Lim, Kaepo 1-cha Woosung Apt. 1-1502, #503 Daechi-dong, Kangnam-ku; Byung Don Lee, both of Seoul (KR)

(73) Assignee: Jung Soo Lim, Seoul (KR)

( * ) Notice: Subject to any disclaimer, the term of this patent is extended or adjusted under 35 U.S.C. 154(b) by 0 days.

(21) Appl. No.: 09/470,908

(22) Filed: Dec. 23, 1999

(30) Foreign Application Priority Data

Sep. 21, 1999 (KR) ..... 99-40837
Oct. 21, 1999 (KR) ..... 99-45923

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 3,737,163 A * 6/1973 Sumrall ..... 272/69
4,406,451 A * 9/1983 Gaetano ..... 272/69
4,886,266 A 12/1989 Trulaske
4,974,831 A 12/1990 Dunham
4,984,810 A 1/1991 Stearns et al.
5,072,928 A 12/1991 Stearns et al.
5,336,145 A * 8/1994 Keiser ..... 482/54
5,385,520 A * 1/1995 Lepine et al. ..... 482/54
5,857,942 A 1/1999 Moon et al.
6,152,854 A * 11/2000 Carmein ..... 482/4

* cited by examiner

*Primary Examiner*—Glenn E. Richman
(74) *Attorney, Agent, or Firm*—Pillsbury Winthrop LLP

(57) ABSTRACT

Disclosed is a treadmill including a walking belt driven forward and backward and when changed from a forward moving mode to a backward moving mode, which can re-adjust a driving speed of a servomotor and an inclination angle of the walking belt. The treadmill according to the present invention includes: selector for driving the walking belt backward; the selector for driving the servomotor backward by receiving a command of the selector for driving the walking belt backward; when the servomotor is driven backward, a selector for selecting the velocity of the servomotor to input the selected velocity data to the servomotor; a selector for selecting an inclination angle of the walking belt to drive an inclination angle motor based upon the selected inclination angle; and a maintainer for maintaining the tension of the walking belt.

8 Claims, 2 Drawing Sheets

TREADMILL WHICH CAN BE DRIVEN IN BOTH DIRECTIONS

BACKGROUND OF THE INVENTION

1. Field of the Invention

Figure 1:
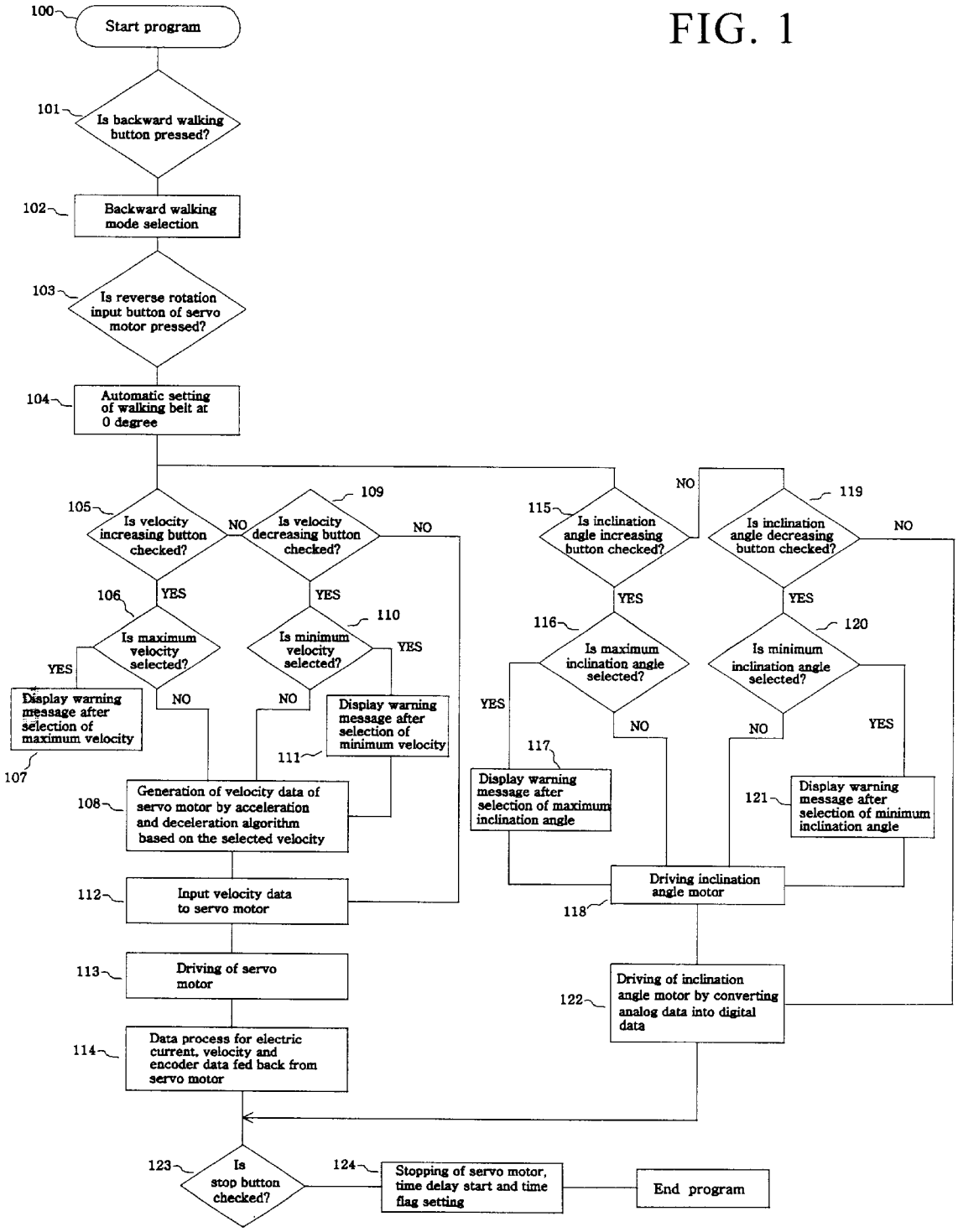

The present invention relates to a treadmill, and more particularly, to a treadmill with a walking belt which can be driven forward and backward.

2. Discussion of Related Art

Generally, a treadmill as indoor sporting goods is widely spread. As well known, the treadmill allows a user to walk or lightly run on a walking belt moving in a forward direction. The advantages obtained by using the treadmill are as follows: firstly, the exercise through the treadmill is taken in a small area; and secondly, the obtained effect from the exercise through the treadmill is sent to the whole body of the user. Because of such advantages, the number of users for the treadmill is gradually increased.

Most of users desire to walk or run on the walking belt moving forward and backward to thereby increase the exercise effect, however, there is not presented any treadmill with the walking belt which can be driven in both the directions.

When a person walks or runs forward, since his heel prior to his toes is touched on the ground, the muscle of the lower part of his body works in order of the calf of the leg (the region between the knee and ankle on the back of the body), the femoral region (thigh, the region between the knee and waist on the front of the body), the shin (the region between the knee and the ankle on the front of the body), the back region of the thigh (the region between the knee and waist on the back of the body), and the hips. Also, since the shoulders and arms of the upper part of his body are moved from the front direction to the back direction, the working order of each muscle of the upper part of his body and the muscles mainly used during walking or running are defined under a predetermined pattern.

To the contrary, when he walks or runs backward, since his toes prior to his heel are touched on the ground, the muscle of the lower part of his body works in order of the shin, the femoral region, the back region of the thigh, the calf of the leg, and the hips. The exercise taken by walking or running backward exhibits an opposite effect to that by walking or running forward. If, therefore, the forwarding walking or running and the backward walking or running are executed in turn, the balancing development of the muscles can be expected and thereby, the performance for controlling the body can be improved.

Because of the above advantages obtained from the backward walking or running, most of users desire to walk or run on the treadmill, but unfortunately, since there is not presented any treadmill which can be driven backward, the users walk and run on the walking belt in the state where they turn around. However, at the time when the re-adjustment of the state on the console attached on the front portion of the treadmill is needed during walking or running in the state where the user turns around, there occurs an inconvenience that the user should turn around on the moving walking belt. At this time, the user often loses his balancing and falls down or seriously damaged because of his sudden direction change.

SUMMARY OF THE INVENTION

Accordingly, the present invention is directed to a treadmill which can be driven in both directions that substantially obviates one or more of the problems due to limitations and disadvantages of the related arts.

An object of the invention is to provide a treadmill with a walking belt which can be driven forward and backward.

To accomplish the above and other objects of the present invention, there is provided a treadmill which can be driven in both directions including: a walking belt driven forward and backward.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings.

Figure 2:
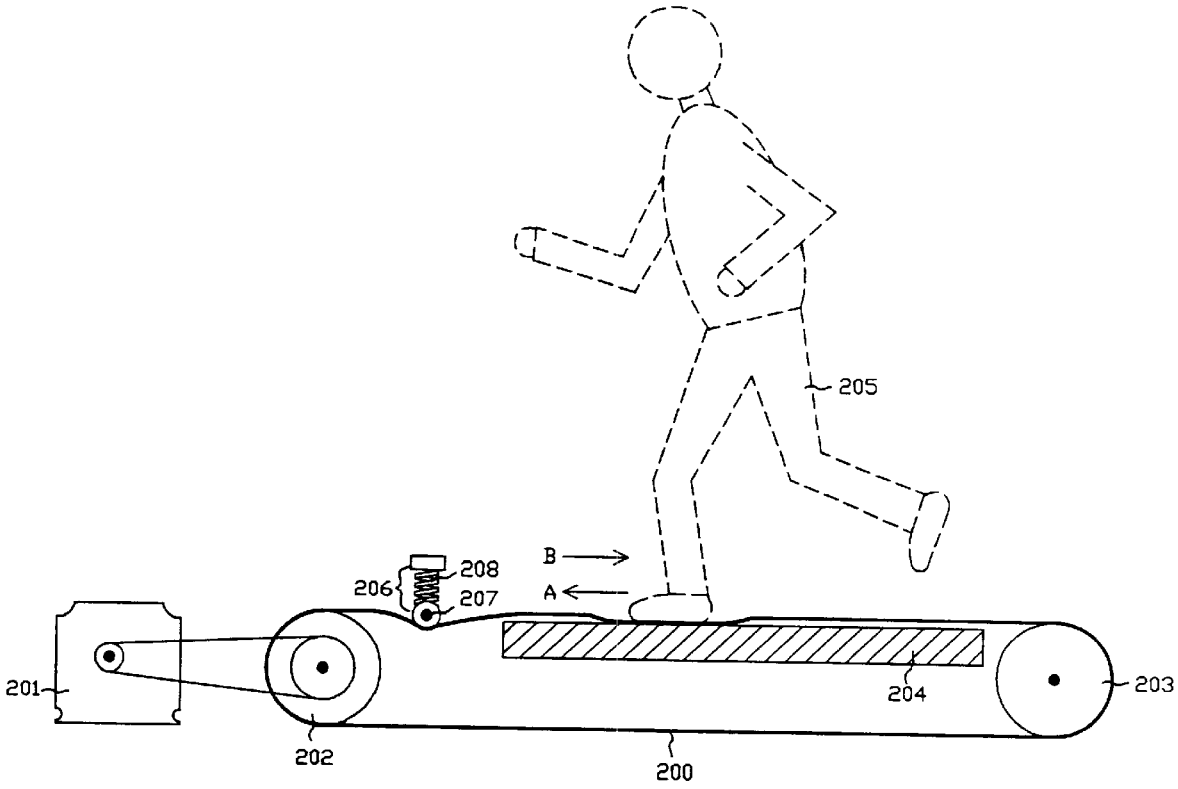

In the drawings:

FIG. 1 is a flowchart illustrating driving steps for a treadmill which can be driven in both directions according to the present invention; and FIG. 2 is a longitudinal sectional view illustrating a schematic structure of main parts in the treadmill which can be driven in both directions according to the present invention.

DETAILED DESCRIPTION OF PREFERRED EMBODIMENT

Reference will now be made in detail to the preferred embodiments of the present invention, examples of which are illustrated in the accompanying drawings.

Generally, the velocity measured when the adult walks at a rapid speed is about 4–5 km per hour. The walking belt of the treadmill is usually driven within the range of a velocity of 0.1–16 km per hour in the front direction. When the user walks or runs on the walking belt in the back direction, however, the increment of the velocity is somewhat difficult when compared with that in the front direction. The result obtained by the treadmill users as an object of the investigation indicates the maximum velocity where the users can safely walk on the treadmill in the state they turn around is about 4 to 5 km per hour. Accordingly, the treadmill which can be driven in both directions according to the present invention is characterized in that the treadmill is automatically adjusted, when changing from a forward movement mode to a backward movement mode, not to exceed the range of a velocity of 0.1 to 4 km. To this end, the treadmill of the present invention includes a control program that can control a velocity of a servomotor within the range of the velocity of 0.1 to 4 km by receiving the feedback of an encoder mounted on the alternating current servomotor.

In case of the treadmill which is driven forward, it has general functions of adjusting the velocity of the walking belt and adjusting the angle of inclination. The inclination angle of the walking belt of the treadmill is about 0 to 12 degrees. In the case where the treadmill is driven backward, however, if the inclination angle of the walking belt is over 3 to 5 degrees, the user has much difficulties in walking or running on the walking belt. This means that when a person comes down from a steep path in the state he turns around, he fails to control his body and falls down. Secondly, the treadmill which can be driven in both directions according to the present invention is characterized in that the inclination angle of the walking belt is automatically adjusted to be under 3 degrees, when the treadmill is changed from a forward moving mode to a backward moving mode, and the inclination angle of the walking belt is adjusted to be within the range −3 to +3 degrees, to thereby give the effect generated when a person goes up a slope in the state he turns around.

Finally, the treadmill which can be driven in both directions according to the present invention is characterized in that a tension adjusting device is installed on the back portion of a driving roller on the front portion of the treadmill, for preventing the deviation of a walking belt from the driving roller caused due to the variation of tension generated when the walking belt of the treadmill is driven backward.

FIG. 1 is a flowchart illustrating driving steps for a treadmill which can be driven in both directions according to the present invention.

The method of driving the treadmill forward in the present invention is same as in the conventional treadmill, an explanation of which will be avoided, for the brevity of the description.

If a backward driving key is pressed to drive the treadmill backward, a backward driving program is started at step 100. Next, at step 102 it is checked whether a backward walking button is pressed, and at step 102 a backward walking mode is selected. Then, it is checked whether a reverse rotation input button of a servomotor is pressed at step 103. If it is checked that the reverse rotation input button is operated normally, the inclination angle of the walking belt of the treadmill is automatically set at 0 degree, at step 104. It is then checked whether the velocity of the servomotor is accelerated at step 105, and if the velocity thereof is to be accelerated, it is checked whether the velocity of the servomotor is accelerated up to a maximum velocity (i.e. a velocity of 4 km per hour) at step 106. If it is checked that the velocity thereof is to be accelerated up to the maximum velocity, a warning message corresponding to the checked result is displayed on a manipulation panel at step 107. Based upon the selected maximum velocity, at step 108 velocity data of the servomotor is produced.

On the other hand, if a predetermined velocity for the servomotor is selected at the step 106, the velocity data of the servomotor is produced based upon the selected predetermined velocity at the step 108.

If it is checked that the velocity of servomotor is not increased at the step 105, it is at step 109 checked whether the velocity thereof is decelerated. If it is checked that the velocity thereof is decelerated, it is checked whether the velocity of the servomotor is decelerated up to a minimum velocity (i.e., a velocity of 0.1 km per hour) at step 110. If it is checked that the velocity thereof is to be decelerated up to the minimum velocity, a warning message corresponding to the checked result is displayed on the manipulation panel at step 111. Based upon the selected minimum velocity, at the step 108 the velocity data of the servomotor is produced.

On the other hand, if a predetermined velocity for the servomotor is selected at the step 110, the velocity data of the servomotor is produced based upon the selected predetermined velocity at the step 108.

If the velocity of the servomotor is neither accelerated nor decelerated at the steps 106 or 110, the velocity data of the servomotor is produced based upon its original velocity at the step 108.

The velocity data produced at the step 108 is inputted to the servomotor at step 112, and then the servomotor is driven at the selected predetermined velocity at step 113. According to the velocity data based upon the accelerated velocity, the decelerated velocity or the original velocity, the servomotor is driven backward, such that the walking belt of the treadmill is driven backward.

In the embodiment of the present invention, the velocity data of the servomotor is all produced at the step 108, based upon the accelerated velocity selected at the steps 106 or 107 or the decelerated velocity selected at the steps 110 or 111, but they may be produced at the steps 108 and 112 taken by using separate devices operating independently in each case of the acceleration and deceleration of the servomotor.

At step 114, the feedback process for the electric current, velocity and encoder data returned from the servomotor is executed.

As discussed above, on the other hand, at the step 114 the inclination angle of the walking belt of the treadmill is automatically set at 0 degree. It is then checked whether the inclination angle of the walking belt is increased at step 115, and if the inclination angle thereof is to be increased, it is checked whether the inclination angle thereof is increased up to a maximum inclination angle (i.e. 3 degrees) at step 116. If it is checked that the inclination angle thereof is to be accelerated up to the maximum inclination angle, a warning message corresponding to the checked result is displayed on the manipulation panel at step 117. Based upon the selected maximum inclination angle, at step 118 an inclination angle motor is driven.

On the other hand, if a predetermined inclination angle for the walking belt is selected at the step 116, the inclination angle motor is driven based upon the selected predetermined inclination angle at the step 118.

To the contrary, if the inclination angle of the walking belt is not to be increased at the step 115, and it is checked whether the inclination angle thereof is decreased at step 119. And, if the inclination angle thereof is to be decreased, it is checked whether the inclination angle thereof is decreased up to a minimum inclination angle (i.e., −3 degrees) at step 120. If it is checked that the inclination angle thereof is to be decelerated up to the minimum inclination angle, a warning message corresponding to the checked result is displayed on the manipulation panel at step 121. Based upon the selected minimum inclination angle, at step 118 the inclination angle motor is driven.

On the other hand, if a predetermined inclination angle for the walking belt is selected at the step 120, the inclination angle motor is driven based upon the selected predetermined inclination angle at the step 118.

If the inclination angle of the walking belt is neither increased nor decreased at the steps 115 or 119, there is no need to drive the inclination angle motor, and the walking belt maintains its original inclination angle (i.e. 0 degree).

At step 122, the driving of the inclination angle motor is checked by converting analog data into digital data.

In the embodiment of the present invention, the inclination angle motor is driven at the step 118, based upon the increased inclination angle selected at the steps 116 or 117 or the decreased inclination angle selected at the steps 120 or 121, but it may be driven at the steps 118 and 122 taken by using separate devices operating independently in each case of the increment and decrement of the inclination angle.

If the backward driving of the servomotor is to be stopped, a stop button is checked at step 123, and the driving of the servomotor is stopped at step 124. At the same time, a time delay start and a time flag setting began to complete the above program.

The principles of the present invention are described with reference to the flowchart for the operation order for driving the treadmill which can be driven in both directions, but it will be understood that the devices for embodying each step in the operation order are obvious to those skilled in the art. Accordingly, the present invention should be appreciated through the steps for driving the treadmill according to the present invention as well as the devices for embodying the steps of the present invention.

FIG. 2 is a longitudinal sectional view illustrating a schematic structure of main parts in the treadmill which can be driven in both directions according to the present invention. When the walking belt 200 of the treadmill is driven forward, a front roller 202 is driven in a counterclockwise direction by the rotation of a motor 201, and thereby the walking belt 200 is moved towards an arrow 'A'. A back roller 203, which is not connected to the motor, is a traveling roller. The walking belt 200 installs a supporting plate 204 for supporting the weight of a user 205 on the back surface thereof. Typically, the gap of about 2 to 3 mm between the back surface of the walking belt 200 and the supporting plate 204 is formed.

When the walking belt 200 of the treadmill is driven backward, the front roller 202 is driven in a clockwise direction by the reverse rotation of the motor 201, and thereby the walking belt 200 is moved towards an arrow 'B'. At this time, the walking belt 200 is in contact with the supporting plate 204 on the foot of the user to which his weight is loaded, and thereby the walking belt 200 is not smoothly moved in the direction of arrow 'B'. In this case, the part of the walking belt 200 positioned between the front roller 202 and the user 205 is raised upwardly, and thereby, the friction coefficient between the walking belt 200 and the front roller 202 falls drastically under a predetermined value.

As a result, since the walking belt 200 is not driven at an expected speed due to the sliding occurring between the walking belt 200 and the front roller 202, the user becomes feel the walking belt 200 stopping abruptly and is likely to fall down. In addition, as the front roller 202 is continually driven in the clockwise direction, an excessive tension is loaded to the part of the walking belt 200 ranged from the back portion of the user 205 and the back roller 203 to the lower portion of the front roller 202, which results in the deformation of the walking belt 200.

To prevent the problems suffered in the backward driving of the walking belt, the treadmill according to the present invention includes a tension adjusting device 206 on the intermediate portion between the front roller 202 and the supporting plate 204. The tension adjusting device 206 is comprised of a tension roller 207 and a spring 208. The spring 208 is adapted to sense the swelling part of the walking belt 200 between the front roller 202 and the user 205, when the walking belt 200 is driven backward and to press the tension roller 207 downward to maintain the tension of the walking belt 200 at a constant level. The spring 208 is formed to sense the minute variation of the tension of the walking belt 200 and adjust the pressure against the tension roller 207. Desirably, the tension roller 207 is coated with urethane on the surface thereof to thereby increase the friction force with the walking belt 200.

As discussed above, a treadmill which can be driven in both directions according to the present invention is embodied with a simple key manipulation and removes a conventional inconvenience that the state on a console is re-adjusted during walking or running in the state where a user turns around. Moreover, a treadmill which can be driven in both directions according to the present invention adjusts the tension of the walking belt at a constant level when the servomotor is driven backward and simultaneously re-adjusts the speed of the servomotor and the inclination angle of the walking belt, to thereby eliminate the problem that the user loses his balance and falls down or is damaged.

It will be apparent to those skilled in the art that various modifications and variations can be made in a treadmill which can be driven in both directions according to the present invention without departing from the spirit or scope of the invention. Thus, it is intended that the present invention covers the modifications and variations of this invention provided they come within the scope of the appended claims and their equivalents.

What is claimed is:

1. A treadmill which can be driven in both directions, comprising:

selecting means for driving a walking belt backward;

selecting means for driving a servomotor backward by receiving a command of said selecting means f or driving said walking belt backward;

selecting means for accelerating said servomotor;

inputting means for inputting the selected velocity data to said servomotor when an accelerating velocity is selected by said acceleration selecting means;

selecting means for decelerating said servomotor;

inputting means for inputting the selected velocity data to said servomotor when a decelerating velocity is selected by said deceleration selecting means;

inputting means for inputting its original velocity data to said servomotor when said acceleration selecting means or said deceleration selecting means is not operated;

a servomotor driven backward by receiving any command of said accelerating velocity data, said deceleration velocity data, or said original velocity data;

a walking belt driven backward by the backward driving of said servomotor;

adjusting means for automatically adjusting an inclination angle of said walking belt to 0 degree, when said walking belt is changed from a forward driving mode to a backward driving mode;

means for increasing the inclination angle of said walking belt;

driving means for driving an inclination angle motor based upon the increased inclination angle by said inclination angle increasing means;

means for decreasing the inclination angle of said walking belt;

driving means for driving an inclination angle motor based upon the decreased inclination angle by said inclination angle decreasing means; and means for maintaining the tension of said walking belt.

2. A treadmill as in claim 1, wherein said tension maintaining means of said walking belt is comprised of a roller and a spring.

3. A treadmill as in claim 1, wherein said inputting means of said accelerating velocity data to said servomotor, said inputting means of said decelerating velocity data to said servomotor, and said inputting means of said original velocity data to said servomotor are formed to be unified with each other.

4. A treadmill as in claim 1, further comprising selecting means for selecting a maximum velocity of said servomotor by receiving a command of said acceleration selection means and selecting means for selecting a minimum velocity of said servomotor by receiving a command of said deceleration selection means.

5. A treadmill as in claim 1, wherein said inclination angle increasing means of said walking belt is formed as a unitary body with said inclination angle decreasing means of said walking belt.

6. A treadmill as in claim 1, further comprising selecting means for selecting a maximum inclination angle of said walking belt by receiving a command of said inclination angle increasing means and selecting means for selecting a minimum inclination angle of said walking belt by receiving a command of said inclination angle decreasing means.

7. A treadmill as in claim 3, further comprising selecting means for selecting a maximum velocity of said servomotor by receiving a command of said acceleration selection means and selecting means for selecting a minimum velocity of said servomotor by receiving a command of said deceleration selection means.

8. A treadmill as in claim 5, further comprising selecting means for selecting a maximum inclination angle of said walking belt by receiving a command of said inclination angle increasing means and selecting means for selecting a minimum inclination angle of said walking belt by receiving a command of said inclination angle decreasing means.

* * * * *